US008409666B2

(12) United States Patent
Lee

(10) Patent No.: US 8,409,666 B2
(45) Date of Patent: Apr. 2, 2013

(54) PROCESS TO MANUFACTURE MAIN BODY OF BIKE HELMET

(75) Inventor: Te Lung Lee, Yung Kang (TW)

(73) Assignee: Long Huei Helmet Co., Yung Kang (TW)

( * ) Notice: Subject to any disclaimer, the term of this patent is extended or adjusted under 35 U.S.C. 154(b) by 665 days.

(21) Appl. No.: 12/629,970

(22) Filed: Dec. 3, 2009

(65) Prior Publication Data

US 2011/0135825 A1 Jun. 9, 2011

(51) Int. Cl.
*B05D 1/36* (2006.01)
*B05D 1/02* (2006.01)

(52) U.S. Cl. ..... 427/258; 427/402; 427/407.1; 427/427.4

(58) Field of Classification Search ..... None
See application file for complete search history.

(56) References Cited

U.S. PATENT DOCUMENTS

| | | | | |
|---|---|---|---|---|
| 4,288,268 | A * | 9/1981 | Hartung | 156/245 |
| 5,790,988 | A * | 8/1998 | Guadagnino et al. | 2/411 |
| 6,803,005 | B2 * | 10/2004 | Dennis et al. | 264/219 |
| 6,911,109 | B2 * | 6/2005 | Giroux et al. | 156/305 |
| 7,547,372 | B1 * | 6/2009 | Sloan | 156/241 |

* cited by examiner

*Primary Examiner* — Timothy Meeks
*Assistant Examiner* — Ina Agaj
(74) *Attorney, Agent, or Firm* — Alan Kamrath; Kamrath IP Lawfirm, P.A.

(57) ABSTRACT

A process of manufacturing the main body of a bike helmet includes the following steps: (I.) coating with a base layer resin: that is, uniformly coating the entire shock absorbing liner with a base layer resin; (II.) coating with a protective layer resin: uniformly coating the base layer resin with a protective layer resin to form a shell; (III.) transferring pattern: transferring the pattern to print on the shell; and (IV.) clear coating: spraying clear coating on the pattern. By the aforesaid steps of the process, the shock absorbing liner and the shell are able to join tightly, which solidifies the helmet for better durability, to prolong the years of use, to substantially lower the production cost, and to boost the yield rate.

5 Claims, 5 Drawing Sheets

PROCESS TO MANUFACTURE MAIN BODY OF BIKE HELMET

BACKGROUND OF THE INVENTION

1. Field of the Invention

This invention relates generally to a process of manufacturing the main body of a bike helmet and, more particularly, to one capable of lowering cost, boosting yield rate, solidifying the helmet and prolonging years of use.

2. Description of the Prior Art

The main body of a bike helmet is made up of a shock absorbing liner and a shell. The shock absorbing liner is made from thermoformed expanded polystyrene (EPS) material, and the shell is made from vacuum formed polycarbonate (PC) or polyvinyl chloride (PVC) sheets. The way of combining the EPS with the shell can be categorized into the following two kinds:

(I.) A two-piece unit made from the combination of the EPS and the shell, shown in FIG. 1, is a middle and low-price product, and its manufacturing process is as follows:

1.) Cut out an adequate size for a PVC or PC sheet, and print a pattern.

2.) Heat the PVC or PC sheet with the printed pattern to be softened, followed by an exploiting vacuum forming method to get a shell 2.

3.) Trim the edges and openings of the shell 2.

4.) Attach the shell 2 to the EPS 1 by a tape 11 (or glue) to form a head cover of a helmet.

However, the two-piece category surely has the following shortcomings:

1.) During the process, the required molds, fixtures and cutters must consume extreme expenditure.

2.) Since the combination between the shell 2 and EPS 1 is adhered by some kind of adhesive, which couldn't be joined closely, bubbles and hollows exist in between. On the other hand, the tape 11 will sooner or later fall off, being subject to blowing wind, drying sun and sprinkling rain.

3.) Due to the constraint of the de-molding angle of the mold, the shell 2 fails to shield the completeness of the EPS 1. Therefore, this kind of helmet has a shorter life cycle, and its appearance is prone to cracks or depressions by accidental collisions.

4.) Trimming for irregular openings is always time consuming and leads to a high defective rate.

(II.) A single-piece unit made from all-in-one forming, and in mold forming (IMF), shown in FIGS. 2 & 3, is a high-end product, and its manufacturing process is as follows:

1.) Trim a PC sheet first, and print a pattern.

2.) Heat the PC sheet with the printed pattern to be softened, followed by an exploiting vacuum forming method to get a shell 2'.

3.) Trim the edges and openings of the shell 2'.

4.) Place the shell 2' fixedly in the forming mold of the EPS 1', filling in with the EPS substance, and heat the EPS particles with steam to expand into a forming head cover.

However, this single-piece category again has the following shortcomings:

1.) The mold calls for high precision, which substantially boosts the cost of the molding.

2.) The printing ink for the print of the pattern must sustain high temperature and feature great ductility, which substantially boosts the cost of the printing ink.

3.) Trimming for irregular openings is always time consuming and leads to a high defective rate, which demands investment for automatic trimming equipment, and it boosts the cost of the investment.

4.) The tightness between the shell and the mold is highly demanded, the making control over it hard, and that lifts the defective rate.

SUMMARY OF THE INVENTION

An objective of this invention is to provide a process of manufacturing the main body of a bike helmet, having its shock absorbing liner and shell tightly joined together, which solidifies the helmet for better durability.

Another objective of this invention is to provide a process of manufacturing the main body of a bike helmet, capable of effectively and completely shielding the expanded polystyrene (EPS) liner, which prolongs the years of using the helmet. A further objective of this invention is to provide a process of manufacturing the main body of a bike helmet, free of the use of a vacuum forming mold for the shell and free of the use of fixtures, cutters and trimming facilities, which could effectively lower the production cost.

A still further objective of this invention is to provide a process of manufacturing the main body of a bike helmet, featuring handiness in controlling the process, which could substantially lift the yield rate.

To accomplish the aforementioned objectives, the steps of the process of this invention comprise: (I.) coating with base layer resin: that is, uniformly coating the entire shock absorbing liner with a base layer resin; (II.) coating with a protective layer resin: that is uniformly coating the base layer resin with a protective layer resin, to form a shell; (III.) transferring pattern: transferring the pattern to print on the shell; and (IV.) clear coating: spraying clear coat on the pattern. By the aforesaid steps of the process, the shock absorbing liner and the shell are able to join tightly, which solidifies the helmet for better durability, to prolong the years of use, to substantially lower the production cost, and to boost the yield rate.

DETAILED DESCRIPTION OF THE INVENTION

The technique adopted and the function achieved are described in detail with reference to the following preferred embodiments and the accompanying drawings, which would give a thorough comprehension on the present invention.

Figure 1:
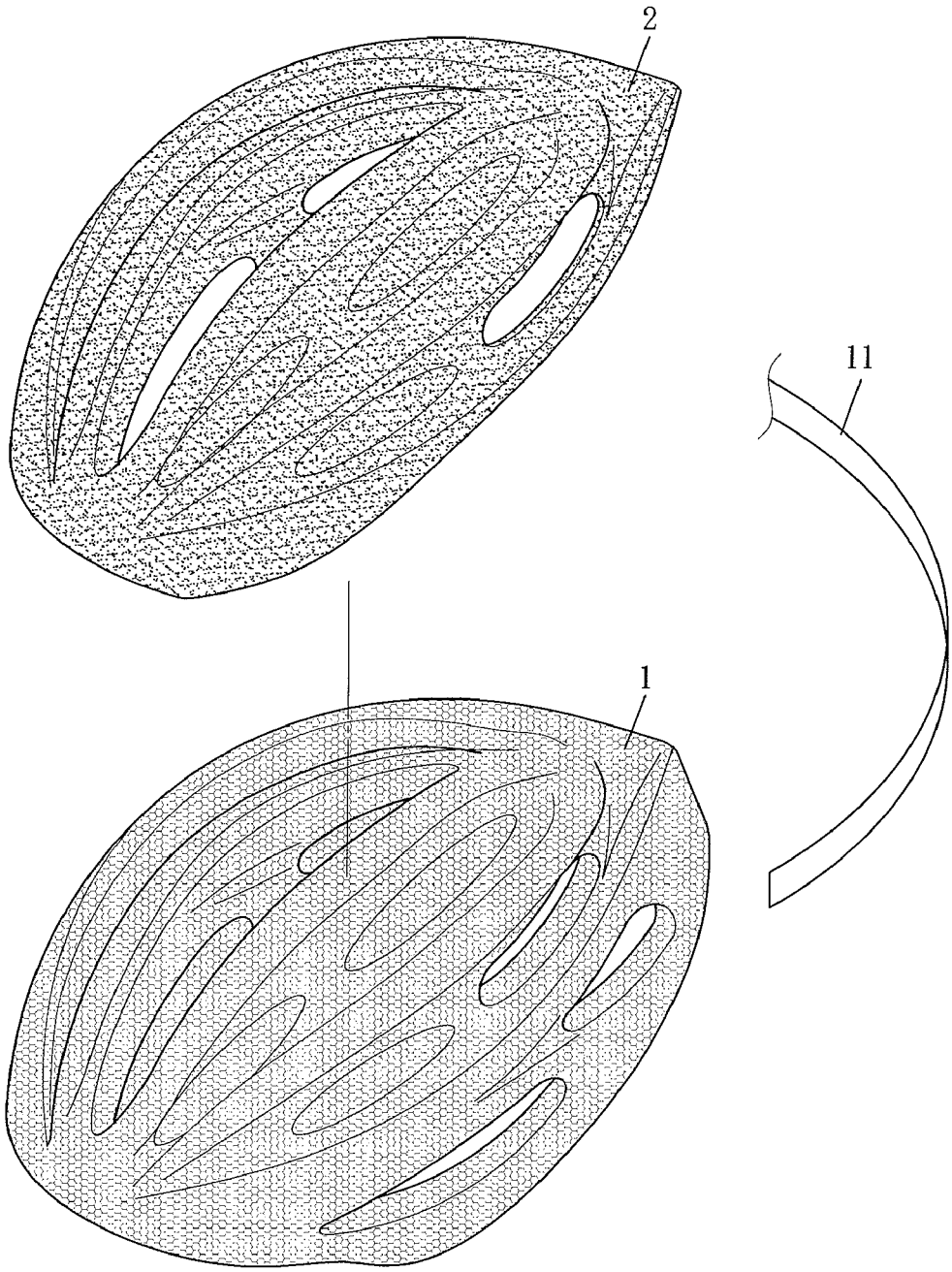
FIG. 1 (PRIOR ART)
FIG. 1 is a three-dimensional exploded view of the main body of a bike helmet of the prior art (I.)
Figure 2:
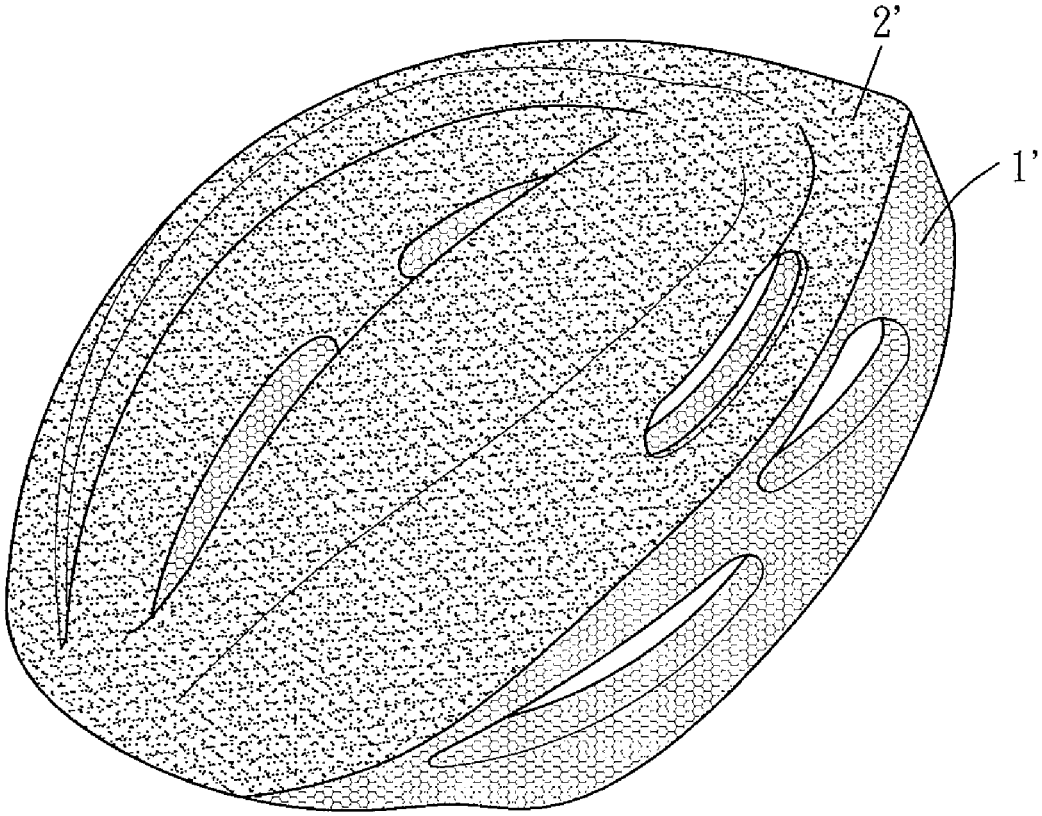
FIG. 2 (PRIOR ART)
FIG. 2 is a three-dimensional exploded view of the main body of a bike helmet of the prior art (II.)
Figure 3:
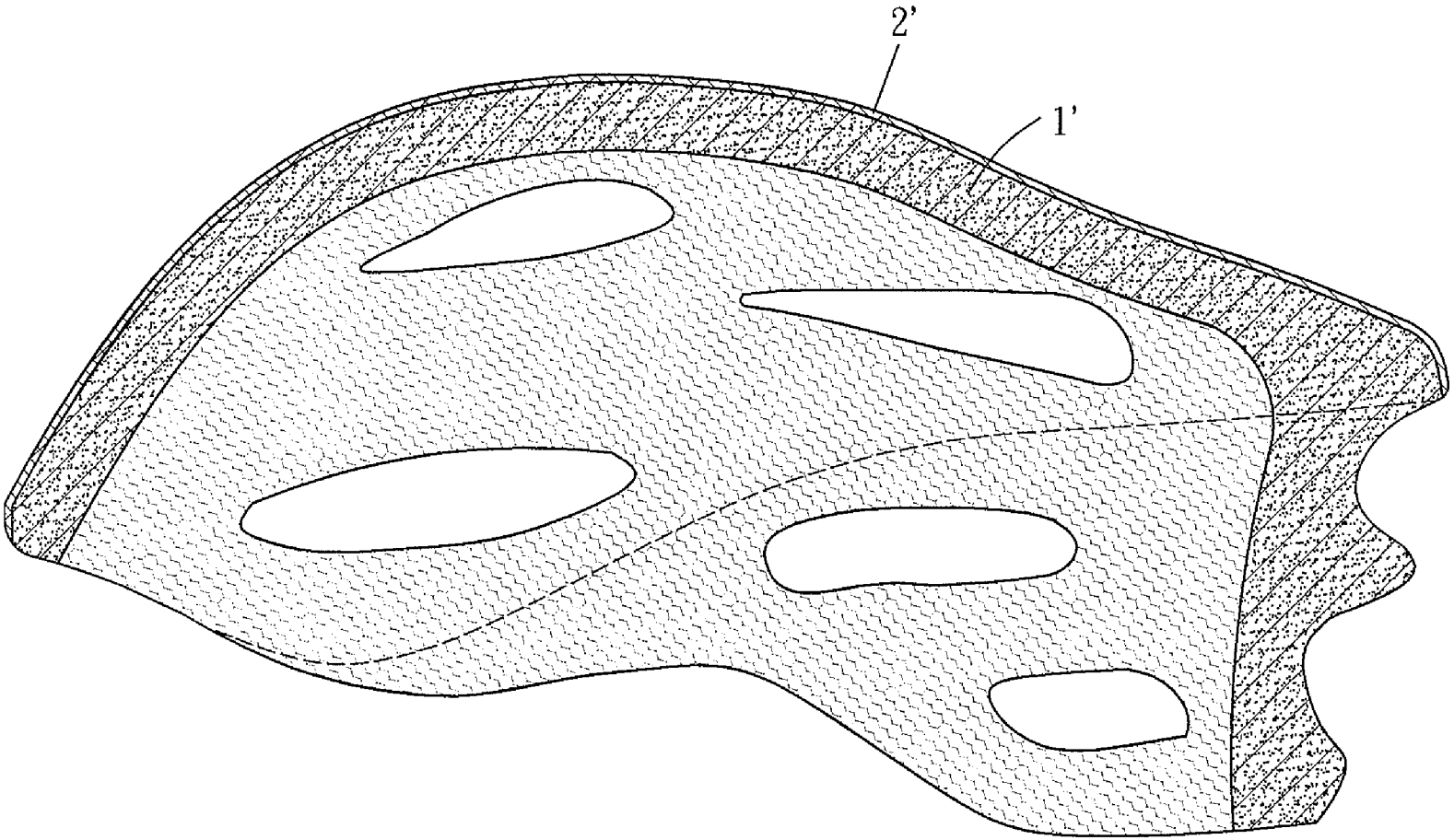
FIG. 3 (PRIOR ART)
FIG. 3 is an assembled sectional view of the main body of a bike helmet of the prior art (II.)
Figure 4:
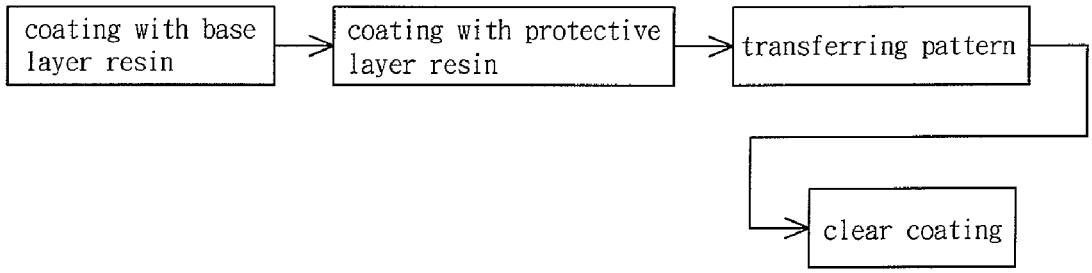
FIG. 4 is a block schematic diagram of this invention.

Referring to FIG. 4, this invention comprises the following steps of the process: (I.) coating with base layer resin, (II.) coating with protective layer resin, (III.) transferring pattern, and (IV.) clear coating.

(I.) Coating with base layer resin. The entire expanded polystyrene (EPS) (including the inner and outer surfaces of the EPS) is coated with a base layer resin uniformly. The purpose of this step is to arrange a shield for the EPS substance against erosion by a solvent in the coming steps, and to help in prolonging the use of the main body. The way for coating comprises: spray coating, dipping coating, brush coating and flow coating. The base layer resin comprises: (1.) thermosetting resin: for instance, like an epoxy resin, an amino resin, a polyurethane (PU) resin, etc., (2.) thermoplastic resin: like polyvinyl chloride (PVC), polycarbonate (PC), polyester resin, polyvinyl acetate (PVAC), acrylic resin, etc., (3.) water-borne resin: like polyvinyl alcohol (PVA) resin, water-borne PU, water-borne acrylic, water-borne epoxy resin, etc., and (4.) elastomer, like styrene butadiene rubber (SBR), nitrile butadiene rubber (NBR), butadiene rubber (BR), PVAC latex, ethylene vinyl acetate (EVA) latex, alkyl acrylate copolymer (ACM), rubber modify resin and the like. The hardeners associated with the epoxy resin include polyamide, polyamine, phenol-formaldehyde resin, melamine resin, or anhydride. The hardeners associated with amino resin include acrylate polyol resin, alkyd resin, or polyester polyol. Main agents of polyurethane include acrylic polyol, alkyd resin, or polyester polyol, and its associated hardeners include hexamethylene diisocyanate, or toluene diisocyanate (TDI) and the like. Coating with the base layer resin can be accomplished multiple times to achieve the required strength. The properties of the base layer resin conforms to the following requirements, including:

(1.) It has to have satisfactory tightness with the EPS.

(2.) The resins selected should not contain any solvent. However, if required, the right solvent is one free to erode the EPS, for instance, the alcohol solvents: like methanol, ethanol, isopropyl alcohol, n-propanol, n-butanol and isobutanol.

(3.) Since the EPS itself contains air, it is not adequate to be baked after coating with resin. Therefore, the resins selected must engage a chemical reaction to be hardened under a normal temperature.

(II.) Coating with protective layer resin. The base layer resin is uniformly coated with a protective layer resin. The coating on the outer surface of the EPS is enough. However, it could include both the inner and outer surfaces of the EPS in case an extra demand arises. The purpose of coating with this protective layer resin is to shield the EPS from being damaged by careless collisions or abrasions during use, which helps to prolong the use of the helmet. The way for coating comprises: spray coating, dipping coating, brush coating and flow coating. The protective layer resin is about the same with the base layer resin, and also comprises: (1.) thermosetting resin, (2.) thermoplastic resin, (3.) water-borne resin, and (4.) elastomer. The thermosetting resin is associated with hardeners. Coating with the protective layer resin can be accomplished multiple times to achieve the required strength. The properties of the protective layer resin is demanded to conform to the following requirements, including:

(1.) It has to have satisfactory tightness with the base layer resin, and available to bring to a required color.

(2.) Aside from a decrease in the investment on the coating equipment, an increase in the smoothness of the coating surface and the EPS is protected by the base layer resin. The protective layer resins selected are allowed to contain solvents for weakening the denseness, which would facilitate the operation of coating.

(3.) The protective layer resin is expected to be superb as its strength and hardness characteristics are concerned.

(4.) The protective layer resin is allowed to add an appropriate amount of blended solvent to adjust its viscosity.

(III.) Transferring pattern. The pattern is transferred to print on the shell to beautify the helmet for the purpose of pleasing the consumers. The usual approaches for this step are decal transfer and cubic transfer.

(IV.) Clear coating. The purpose of clear coating is to protect the decal and to augment the delicacy of the helmet. As heat resistance, abrasion resistance and tenacity resistance are concerned, polyurethane resin will be the prime selection as the coating material, and spray coating is the way to operate.

An exemplary embodiment is given herewith for the detailed description:

(I.) Coating with base layer resin. Epoxy resin is selected as the base layer resin, which has an epoxy equivalent weight (EEW) of 180 g/eel, and its viscosity is 800 cps. Color ink can be added to make the color black. Polyamide is selected as the hardener. The ratio of the main agent to the hardener is 3:1. Once the mixture is stirred uniformly, it is sprayed onto the EPS pressurized by a reciprocating pump, to spray uniformly on the EPS. The hardened process calls for 8 hours to stay still at room temperature.

(II.) Coating with protective layer resin. Epoxy resin is selected as the base layer resin, which has an epoxy equivalent weight (EEW) of 180 g/eq. Fume silica is added to change its character. The hardener polyamine is added to make the weight ratio of the main agent to the hardener to be 3:1. A blended solvent is also added to adjust the viscosity for 10 seconds to have a value about 200 cps, which is measured by an Iwata NK-2 viscosity cup. The coating done by a gravity-type handheld spray gun is set aside for half an hour, followed by heat drying at a temperature of 50° C. for 2 hours.

(III.) Transferring pattern. The pattern is decal transferred followed by a waiting period for 1 hour.

(IV.) Clear coating. Clear polyurethane coating is sprayed on the decal, left for half an hour, and followed by heat drying at 50° C. 2 hours.

Figure 6:
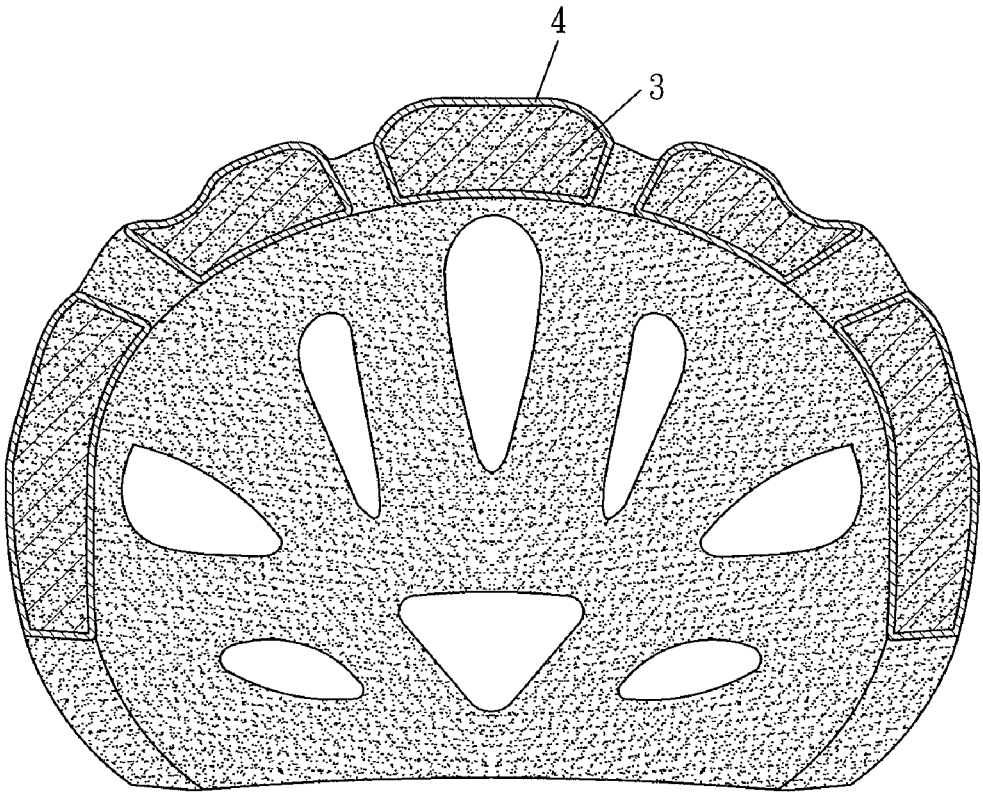
FIG. 6 is a transverse sectional view of the product of this invention.
Figure 5:
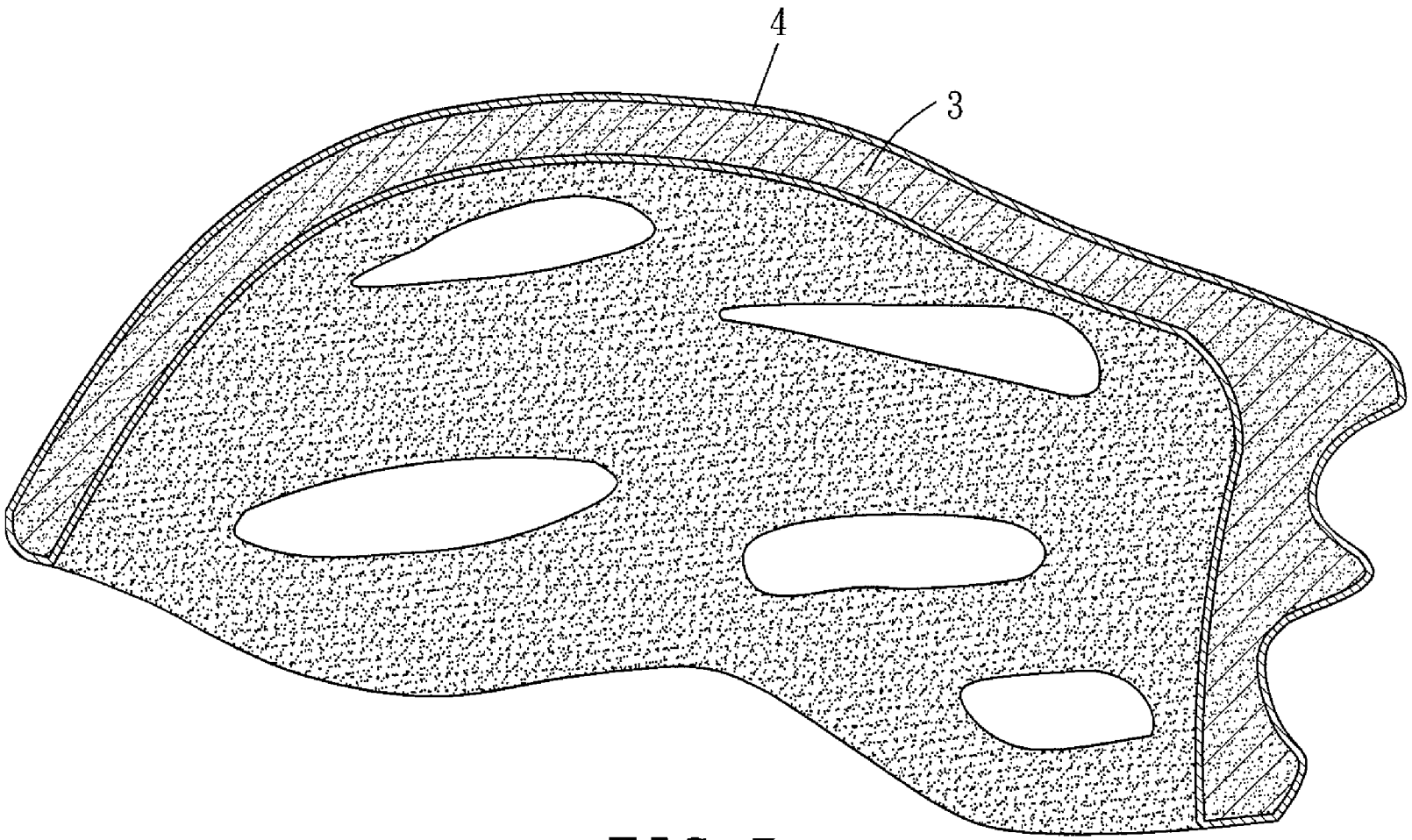
FIG. 5 is a lengthwise sectional view of a product of this invention.

The main body of a bike helmet made from the aforementioned manufacturing process is shown on FIGS. 5 & 6, and the EPS 3 is provided with a base layer resin and a protective layer resin on its outer and inner surfaces, which forms a shell 4. The shell 4 (made up of the base layer resin, the protective layer resin, the decal and the clear coating) is in tight connection with the EPS 3, which solidifies the head cover for long life. This invention comprises the following advantages and functions, which is much creative and useful than the prior art:

1. The EPS is in tight connection with the shell to solidify the head cover for long life.
2. The coating is allover on the EPS without a dead-end, which can effectively and completely shield the EPS. Thus, the coating can no doubt prolong the life of the helmet.
3. The foregoing process does not need a vacuum forming mold for the shell and is also free to use fixtures, cutters and trimming facilities, which effectively lowers the production cost.
4. The process is under control with ease, which absolutely boosts the yield rate.

In conclusion, the present invention indeed accomplished expected objectives and functions, and the disclosure of its technique had not appeared in the prior art, which is construed to be a novel, creative and useful invention.

What is claimed is:

1. A process of manufacturing a main body of a bike helmet comprising:

(I.) entirely uniformly coating an outer side of a shock absorbing liner by spraying with a reciprocating pump with a base layer resin and hardening under room temperature;

(II.) uniformly coating the hardened base layer resin by spraying with a gravity-type handheld spray gun with a protective layer resin, setting aside, and then heating at a temperature of 50° C. to form a shell;

(III.) transferring a pattern to print on the shell; and (IV.) spraying the pattern printed on the shell with clear coating.

2. A process of manufacturing a main body of bike helmets as in claim 1 further comprising adding hardeners to the base layer resin before spraying with the reciprocating pump.

3. A process of manufacturing a main body of bike helmets as in claim 1 further comprising adding hardeners to the protective layer resin before spraying with the gravity type handheld spray gun.

4. A process of manufacturing a main body of bike helmets as in claim 1 further comprising adding blended solvents to the protective layer resin before spraying with the gravity type handheld spray gun.

5. A process of manufacturing a main body of bike helmets as in claim 1 further comprising entirely uniformly coating an inner side of the shock absorbing liner with the base layer resin.

* * * * *